8-167 SR
1/19/82 XR 4,311,605

United States Patent [19]
Eckhardt et al.
[11] 4,311,605
[45] Jan. 19, 1982

[54] COMPOSITIONS FOR TREATING TEXTILES

[75] Inventors: Claude Eckhardt, Riedisheim, France; Richard von Rütte, Riehen, Switzerland

[73] Assignee: Ciba-Geigy Corporation, Ardsley, N.Y.

[21] Appl. No.: 189,486

[22] Filed: Sep. 22, 1980

[30] Foreign Application Priority Data

Sep. 28, 1979 [CH] Switzerland ..... 8789/79

[51] Int. Cl.[3] ..... C11D 7/54; C11D 7/50
[52] U.S. Cl. ..... 252/102; 252/95; 252/99; 252/301.21; 252/301.25; 8/103; 8/107; 8/589
[58] Field of Search ..... 252/102, 95, 99, 301.21, 252/301.25; 8/103, 107, 1 XA

[56] References Cited

U.S. PATENT DOCUMENTS 4,166,718 9/1979 Reinert et al. ..... 252/99 X

FOREIGN PATENT DOCUMENTS 3149 7/1979 European Pat. Off. ..... 252/102

*Primary Examiner*—Mayer Weinblatt
*Attorney, Agent, or Firm*—John P. Spitals; Edward McC. Roberts

[57] ABSTRACT

The invention provides compositions for improving the appearance of used textiles which contains a photoactivator and a fluorescent whitening agent which is a distyrylbiphenylsulfonic acid or a salt thereof and/or a 4,4'-bis-(1,2,3-triazol-2-yl)-2,2'-stilbenesulfonic acid or a salt thereof. The invention also provides soaking, detergent or rinsing liquors containing such compositions as well as a method of improving the appearance of used textiles which comprises the use of the compositions and liquors of the invention.

25 Claims, No Drawings

COMPOSITIONS FOR TREATING TEXTILES

The present invention relates to compositions for improving the appearance of used, in particular soiled, textiles, especially to soaking, detergent or rinsing compositions, as well as to a method of improving the appearance of said textiles which comprises the use of the compositions of the invention.

It is known to use photosensitising compounds, i.e. in particular dyes which catalyse oxidation reactions under the action of light, for bleaching textiles. These compounds can be contained in soaking, detergent, rinsing or other cleansing compositions, or they are used in a separate bleaching process (cf. British Pat. No. 1,372,035, U.S. Pat. No. 3,927,967, and German Offenlegungsschrift Nos. 2 613 936 and 2 812 278). The textiles are treated by adding the appropriate photosensitising compound or a soaking, detergent, rinsing or cleansing composition which contains such a compound, to an aqueous liquor in which the textiles to be bleached are soaked, washed, rinsed or otherwise cleansed. To develop the bleaching action produced by the photodynamic effect it is necessary to irradiate the textiles with light during the treatment. Irradiation can be performed with an appropriate lamp, or most advantageously, especially as regards energy consumption, with daylight. It can be effected during the treatment of the textiles in the bath (e.g. in the bleaching, soaking, washing or rinsing bath) or after the treatment outside the bath. In this latter case, the still moist textiles can be exposed in particular to sunlight, e.g. while drying on the line. However, irradiation can also be effected while repeatedly moistening the textiles again.

It is also known that the appearance of textiles can be substantially improved by adding fluorescent whitening agents to the soaking, washing or rinsing bath in which the textiles are treated. Reference is made in this connection to Eckhardt et al., "Fluorescent Whitening Agents in Detergents" in Environmental Quality and Safety, Suppl. Vol. IV, ed. by Coulston+Korte, G. Thieme Verlag Stuttgart, 1975. The use of fluorescent whitening agents in the soaking, washing and rinsing bath increases the degree of whiteness of white textiles and the brightness of coloured textiles.

Surprisingly, it has now been found that by means of a combination of photosensitising compounds (photoactivators) which are used for bleaching textiles with very specific types of fluorescent whitening agents in the textile treatment baths referred to above, it is possible to obtain a marked improvement in the appearance of soiled textiles—an improvement that cannot be obtained either with the best combinations of photoactivators alone, or with selected fluorescent whiteners alone, or with combinations of the cited photoactivators with the remaining conventional, commercially available known fluorescent whitening agents. The combination of this invention thus results in a synergistic bleaching and whitening effect.

Accordingly, the present invention provides in the first instance a composition for improving the appearance of used, in particular soiled, textiles, said composition comprising 0.0001 to 1%, preferably 0.001 to 0.1%, of a photoactivator, and 0.005 to 1.5%, preferably 0.01 to 0.5%, in each case based on the total weight of the composition, of a fluorescent whitening agent selected from the class of distyrylbiphenylsulfonic acids or their salts and/or of 4,4'-bis-(1,2,3-triazol-2-yl)-2,2'-stilbenesulfonic acids or their salts, which composition may also contain a mixture of several fluorescent whitening agents.

Suitable photoactivators for use in the practice of this invention are all dyes known from the literature that exert a photodynamic effect. Examples of such dyes are eosin, Bengal pink, fluorescein, chlorophyll, metal-free porphyrin, methylene blue, and especially water-soluble phthalocyanine compounds. It is preferred to use these latter in the compositions of the invention. As water-soluble phthalocyanines it is possible to use both metal-free phthalocyanines and metal complexes of phthalocyanines. Metal complexes are in particular those of aluminium, zinc, magnesium, calcium, iron, sodium, potassium, with those of aluminium and zinc being preferred.

Mixtures of photoactivators can, of course, also be used, e.g. mixtures of different phthalocyanines, such as mixtures of water-soluble zinc and aluminium phthalocyanines.

The necessary water-solubility of the phthalocyanines suitable for use as photoactivators in the process of the present invention can be brought about by a wide variety of water-solubilising substituents. Such substituents are known from the literature relating to phathalocyanine dyes, especially copper and nickel phthalocyanine complexes. The water-solubility of a phthalocyanine derivative is sufficient when enough of it goes into solution in the treatment bath in order to effect a photodynamic catalysed oxidation on the fibre. A minimum solubility of as little as 0.01 g/l can be sufficient; but in general a solubility of 0.1 to 20 g/l is advantageous. A number of possible water-solubilising groups are listed hereinafter, although this list is not intended to be exhaustive: Sulfo and carboxyl groups and the salts thereof as well as groups of the formulae

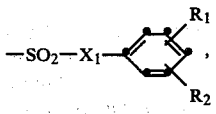
(1)

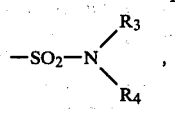
(1a)

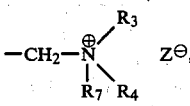
(1b)

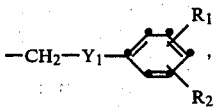
(2)

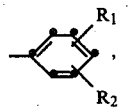
(3)

$-SO_2(CH_2)_n-OSO_3M,$ (4)

$-SO_2(CH_2)_n-SO_3M,$ (4a)

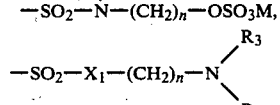
(5)

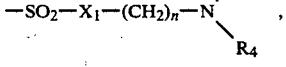
(6)

-continued

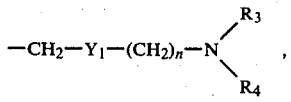

(7)

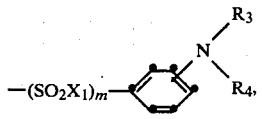

(8)

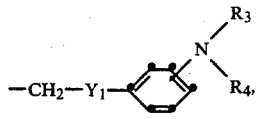

(9)

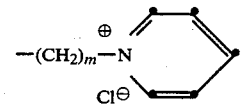

(10)

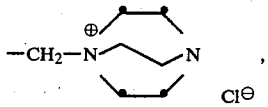

(10a)

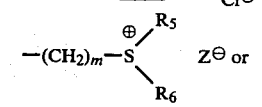

(11)

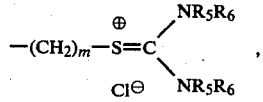

(12)

in which formulae $X_1$ is oxygen, the radical —NH— or —N—alkyl, and $R_1$ and $R_2$, each independently of the other, are hydrogen, the sulfo group and the salts thereof, the carboxyl group and the salts thereof or the hydroxyl group, whilst at least one of the symbols $R_1$ and $R_2$ is a sulfo or carboxyl group or a salt thereof, $Y_1$ is oxygen, sulphur, the radical —NH— or —N—alkyl, $R_3$ and $R_4$, each independently of the other, are hydrogen, alkyl, hydroxyalkyl, cyanoalkyl, sulfoalkyl, carboxyalkyl or haloalkyl, each containing 1 to 6 carbon atoms in the alkyl moiety, phenyl which is unsubstituted or substituted by halogen, alkyl or alkoxy of 1 to 4 carbon atoms, sulfo or carboxyl, or $R_3$ and $R_4$, together with the nitrogen atom to which they are attached, form a saturated 5- or 6-membered heterocyclic ring which can additionally contain a further nitrogen or oxygen atom as ring member, $R_5$ and $R_6$, each independently of the other, are a substituted or unsubstituted alkyl or aralkyl radical, $R_7$ is a substituted or unsubstituted alkyl group of 1 to 6 carbon atoms or hydrogen, M is an alkali metal ion or an ammonium ion, $Z^{\ominus}$ is an anion, for example a chlorine, bromine, alkylsulphate or arylsulphonate ion, n is an integer from 2 to 12, and m is 0 or 1.

In the above formulae, $X_1$ and $Y_1$ are preferably —NH— or —N—alkyl. Halogen preferably denotes chlorine or bromine, especially chlorine. Preferred 5- or 6-membered heterocyclic rings ($R_3+R_4$) are the morpholine, piperidine, pyrazolidine, piperazine and oxazolidine radical.

The number of substituents present in the molecule should be such as to ensure a sufficient water-solubility. If several water-solubilising groups are present in the molecule, these can be the same or different. As is customary in phthalocyanine chemistry, the degree of substitution need not absolutely be a whole number, because products which are not always homogeneous result from the method of manufacture, for example sulfonation. In general, the total number of water-solubilising substituents in each molecule is from 1 to 4.

In addition to the water-solubilising groups, the phthalocyanines suitable for use in the compositions of the invention can also contain other substituents, for example reactive radicals customary in colour chemistry, such as chloropyrazine, chloropyrimidine and, in particular, chlorotriazine radicals. However, other additional substituents may also be present in addition to the water-solubilising groups, the maximum number of these additional substituents being such as not to cause the water-solubility to fall below the required level. On the other hand, only a very small number of such additional substituents may be present, for example about 0.1 mole per mole of phthalocyanine compound. Examples of such substituents are: halogen atoms (including fluorine and iodine), cyano, substituted or unsubstituted alkyl, alkoxy, unsubstituted or substituted phenyl, and other substituents customary in phthalocyanine chemistry. Preferred additional substituents are fluorine, chlorine, bromine, iodine and cyano, with chlorine being preferred.

A particularly suitable photoactivator is a water-soluble phthalocyanine of the formula

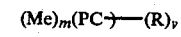

(13)

or

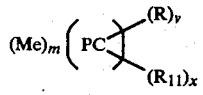

(13a)

wherein

PC is the phthalocyanine ring system, v is any value from 1 to 4,

Me is Zn, Fe(II), Ca, Mg, Na, K or AlX, preferably Zn or AlX, wherein X is an anion, especially a halide, sulfate, nitrate, acetate or hydroxyl ion, m is 0 or 1, and R is a group of the formula

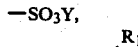

(14)

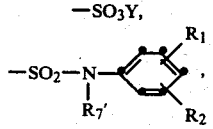

(15)

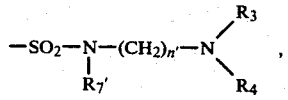

(16)

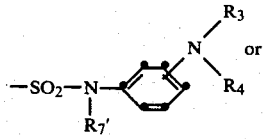

(17)

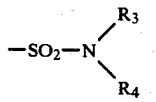

(18)

wherein

Y is hydrogen, an alkali metal, ammonium or amine salt ion, $R_7'$ is hydrogen or alkyl of 1 to 4 carbon atoms, n' is an integer from 2 to 6, $R_1$ and $R_2$, each independently of the other, are hydrogen, the sulfo group and the salts thereof, the carboxyl group and the salts thereof, or the hydroxyl group, whilst at least one of the symbols $R_1$ and $R_2$ is the sulfo or carboxyl group or a salt thereof, and $R_3$ and $R_4$, each independently of the other, are hydrogen, alkyl, hydroxyalkyl, cyanoalkyl, sulfoalkyl, carboxyalkyl or haloalkyl, each containing 1 to 6 carbon atoms in the alkyl moiety, or phenyl, or $R_3$ and $R_4$, together with the nitrogen atom to which they are attached, form a saturated 5- or 6-membered heterocyclic ring which additionally can also contain a further nitrogen or oxygen atom as ring member, with the proviso that, if several radicals R are present in the molecule, these radicals can be the same or different, and wherein $R_{11}$ is fluorine, chlorine, bromine, iodine or cyano, and x is any value from 0.1 to 4, and the radicals $R_{11}$ present in the molecule can be the same or different.

Preferred photoactivators for use in the compositions of the invention are acid substituted phthalocyanine derivatives and their metal complexes, especially those which are substituted by sulfo and/or carboxyl groups, but most preferably sulfonated phthalocyanines and their metal complexes, especially those of the formula $$(Me)_m(PC)\text{—}(SO_3Y')_{v'} \qquad (19)$$

wherein

PC denotes the phthalocyanine ring system,

Y' is hydrogen, an alkali metal ion or an ammonium ion, and v' is any number from B 1.3 to 4 (degree of sulfonation), m is 0 or 1, preferably 1, and Me is Zn, Fe(II), Ca, Mg, Na, K or AlX, with Zn or Al X being preferred, wherein X is an anion, especially a halide, sulfate, hydroxyl or acetate ion, as well as those of the formula

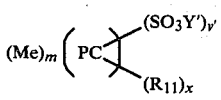

(19a)

wherein

PC denotes the phthalocyanine ring system,

Y' is hydrogen, an alkali metal ion or an ammonium ion, v' is any number from 1.3 to 4 (degree of sulfonation), m is 0 or 1, preferably 1, $R_{11}$ is fluorine, chlorine, bromine, iodine or cyano, x is any number from 0.1 to 4, preferably from 0.5 to 4, most preferably from 0.8 to 3, whilst the radicals $R_{11}$ can be the same or different, and Me is Zn, Fe(II), Ca, Mg, Na, K or Al X, with Zn or Al X being preferred, wherein X is an anion, especially a halide, sulfate, hydroxyl or acetate ion.

Further preferred photoactivators in compositions of the present invention are those of the formula

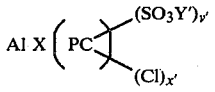

or mixtures of such aluminium phthalocyanines, wherein X is an anion, especially a halide, sulfate, hydroxyl or acetate ion, Y' is hydrogen, an alkali metal ion or an ammonium ion, $R_{11}$ is fluorine, chlorine, bromine, iodine or cyano, v' is any number from 1.3 to 4 (degree of sulfonation), and x' is 0 or any number from 0.5 to 4.

In the case of aluminium complexes, the molecule additionally contains an anion X in order to saturate the third valency of the aluminium ion. This anion X is of no importance for the bleaching effect and is usually identical to that of the aluminium compound which has been used for obtaining the complex.

Especially preferred photoactivators are aluminium and zinc phthalocyanine di-, tri- and tetrasulfonates and their salts which may contain a further additional substituent, e.g. a halogen atom, especially a chlorine atom.

Methods of obtaining all the water-soluble phthalocyanine compounds specified above are described in German Offenlegungsschrift 2 812 261 and 2 812 278. All the phthalocyanine compounds disclosed in these two publications can be used as photoactivators in the compositions of this invention.

The phthalocyanine compounds which are suitable for use as photoactivators in the compositions of this invention and which contain other substituents in addition to the water-solubilising groups, can also be obtained by conventional methods. For example, these substituents can already be present in the starting materials used for the formation of the phthalocyanine ring structure (e.g. phthalic anhydride, phthalodinitrile or phthalodiimide). After the formation of the correspondingly substituted and optionally already metallised phthalocyanine, the water-solubilising groups can be introduced (e.g. by sulfonation), provided these were not also already present in the starting materials. Many substituents can also be introduced into the already formed phthalocyanine ring system, e.g. by chlorination, bromination or iodination ($R_{11}$=Cl, Br, I). The water-solubilising substituents can be introduced beforehand or, preferably, subsequently, e.g. by sulfonation. If the formation of the phthalocyanine ring system is carried out with phthalic anhydride or phthalodinitrile in the presence of a chloride, e.g. $AlCl_3$, $ZnCl_2$ etc., then already chlorinated phthalocyanines are obtained, especially those with a content of 0.5 to 1.5 moles of chlorine per mole of phthalocyanine. The water-solubilising groups can likewise be introduced subsequently into such compounds. To obtain phthalocyanine compounds containing mixed substituents it is possible to combine the methods described above in an appropriate manner. All these methods are well known in phthalocyanine chemistry and are described in detail in the relevant literature.

Fluorescent whitening agents belonging to the class of the distyrylbiphenylsulfonic acids and which are suitable for use in the compositions of the invention, are in particular those of the formula

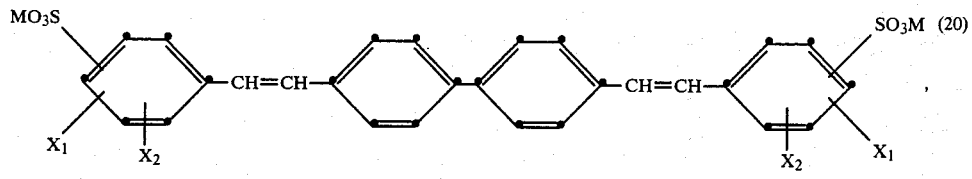

(20)

wherein $X_1$ is hydrogen, chlorine, bromine, or alkyl or alkoxy each containing 1 to 4 carbon atoms, $X_2$ is hydrogen or alkyl of 1 to 4 carbon atoms, and M is hydrogen, an alkali metal ion, ammonium ion or amine salt ion.

Preferred alkali metal ions M in formula (20) are sodium and potassium. Suitable amine salt ions M are chiefly those of the formula $-\overset{+}{H}\overset{-}{N}R_1R_2R_3$, wherein $R_1$ and $R_2$ are hydrogen or unsubstituted or substituted alkyl and $R_3$ is unsubstituted or substituted alkyl. Substituted alkyl radicals, which preferably contain 1 to 4 carbon atoms in the alkyl moiety are in particular hydroxyalkyl, cyanoalkyl, haloalkyl and benzyl. M is preferably hydrogen, sodium, potassium or ammonium.

It is preferred to use fluorescent whitening agents of the formula

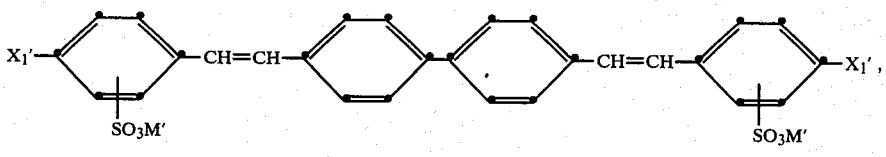

(21)

wherein $X_1'$ is hydrogen or chlorine and M' is hydrogen, sodium, potassium or ammonium; and in particular those of the formula

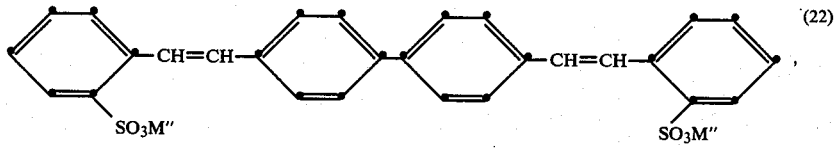

(22)

wherein M'' is hydrogen, sodium or potassium.

Good results are also obtained with compositions which contain the fluorescent whitening agent of the formula

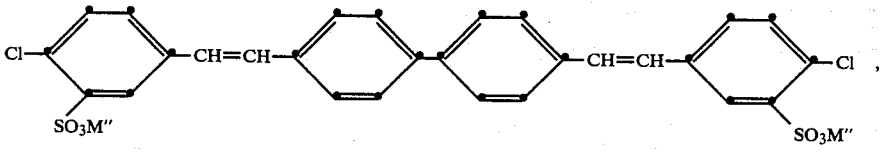

(23)

wherein M'' is hydrogen, sodium or potassium.

A particularly preferred fluorescent whitening agent belonging to the class of the 4,4'-bis-(1,2,3-triazol-2-yl)-2,2'-stilbenesulfonic acids, which are likewise used in the compositions of the invention, is that of the formula

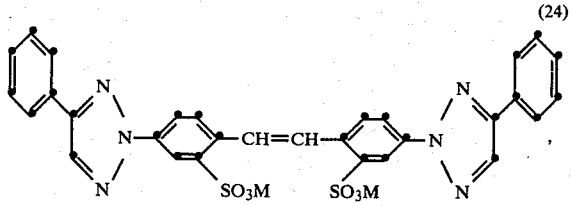

(24)

wherein M is hydrogen, an alkali metal ion, ammonium ion or amine salt ion. The substituents represented by M are as defined above.

It will be understood that mixtures of the fluorescent whitening agents specified above can also be incorporated in the compositions of this invention, especially mixtures of the fluorescent whitening agents of the formulae (22) and (24), and also mixtures of the fluorescent whitening agents of the formulae (22) and (23). In addition, the compositions of the invention can also contain fluorescent whitening agents belonging to other classes besides those specifically referred to as suitable for use in the practice of this invention.

The compositions of the invention which are used for improving the appearance of used, in particular soiled, textiles, are e.g. soaking, detergent, rinsing or other cleansing compositions. Accordingly, in addition to containing fluorescent whitening agent and photoactivator, the compositions are bulked to 100% with constituents which are conventionally employed in such compositions. In general, such constituents are in particular anionic or nonionic surfactants or mixtures of anionic and nonionic surfactants.

Detergent compositions to be used in the practice of this invention can be liquid or solid and they preferably contain, in addition to fluorescent whitening agent and photoactivator, an organic detergent or mixtures of several detergents (preferably anionic and/or nonionic), builders (in solid detergents), redeposition inhibitors, and, optionally, foam stabilisers, enzymes, antimicrobial agents, perfumes, additional bleaching agents and/or additional fluorescent whitening agents as well as water (especially in liquid detergents).

The detergent compositions of this invention particularly comprise known mixtures of active detergents, for example soap in the form of chips and powders, synthetics, soluble salts of sulfonic acid hemiesters of higher fatty alcohols, arylsulfonic acids with higher and/or multiple alkyl substituents, sulfocarboxylic acid esters of medium to higher alcohols, fatty acid acylaminoalkyl- or acylaminoaryl-glycerol sulfonates and phosphoric acid esters of fatty alcohols, nonionic surfactants etc. Suitable builders which can be used are, for example, alkali metal polyphosphates and polymetaphosphates, alkali metal pyrophosphates or aluminosilicates, alkali metal salts of carboxymethyl cellulose and other soil redeposition inhibitors, and also alkali metal and alkaline earth metal silicates, alkali metal carbonates, alkali metal sulfates, alkali metal borates, alkali metal perborates, alkali metal percarbonates, nitrilotriacetic acid, ethylene-diaminetetraacetic acid, and foam stabilisers such as alkanolamides of higher fatty acids. The detergents can further contain for example: bleaching agents such as per compounds, e.g. perborates, percarbonates, etc., agents which liberate active chlorine, antistatic agents, fat restorative skin protectives such as lanolin, enzymes, antimicrobial agents, perfumes, additional fluorescent whitening agents, and bleaching activators such as tetraacetylethylenediamine or tetraacetylglycoluril as well as water.

Soaking compositions to be used in the practice of this invention contain, in addition to fluorescent whitening agent and photoactivator, constituents similar to those specified above for the corresponding detergent compositions. They may contain a higher proportion of enzymes than the detergent compositions.

Rinsing compositions to be used in the practice of this invention contain, in addition to fluorescent whitening agent and photoactivator, the constituents customarily used in such compositions, e.g. as softener, one or more dialkylated di-(lower alkyl)ammonium salts, preferably dialkyldimethylammonium salts, e.g. dimethyldistearylammonium chloride, and/or imidazolinium derivatives, e.g. 1-methyl-2-heptadecyl-3-$\beta$-stearylamidoethylimidazolinium methosulfate. Such rinsing compositions usually contain about 5% of such a softener. They further contain as a rule one or more of the nonionic surfactants (e.g. 0.1 to 1%) also used in detergent compositions (see above). If desired, it is also possible to add perfume, a white pigment (e.g. $TiO_2$), buffer substances and a dye (e.g. a few ppm). In the rinsing compositions of this invention, the photoactivator can simultaneously act as dye. Usually an electrolyte (e.g. an alkali metal salt) is added to the rinsing compositions as viscosity regulator. The composition is usually bulked to 100% with water or with a mixture of water and an alcohol, preferably isopropanol.

It must also be mentioned that the salt content (e.g. sodium sulfate) of the compositions of the invention has a specific influence on the efficiency of the photoactivator. Optimum efficiency of the photoactivator can therefore be achieved by varying the salt content.

As already mentioned, further soil release agents (e.g. perborates or enzymes) in the compositions of the invention can increase the efficiency of the photoactivator.

The compositions of the invention can be easily prepared by all methods conventionally employed in the detergent industry, whether they are liquid formulations or powders or granulates. In particular, the good heat resistance of the photoactivators and fluorescent whiteners employed also allows them to be added to the washing powder slurry, which can be dried by spray drying.

The invention also provides aqueous soaking, wash or rinsing liquors which contain 0.001 to 100 ppm, preferably 0.01 to 10 ppm, of a photoactivator, and 0.05 to 150 ppm, preferably 0.1 to 50 ppm, in each case based on the total liquor, of a fluorescent whitening agent which is a distyrylbiphenylsulfonic acid or a salt thereof and/or a 4,4'-bis-(1,2,3-triazol-2-yl)-2,2'-stilbenesulfonic acid or a salt thereof, which liquors may also contain mixtures of several fluorescent whitening agents.

The fluorescent whitening agents and photoactivators contained in the treatment liquors to be used in the practice of this invention are the same as those defined above for the compositions. The liquors are obtained e.g. by dissolving or dispersing the compositions in water. Alternatively, however, the individual components can be dissolved in water singly or in groups to form the liquors. For example, a known soaking, detergent or rinsing composition can be processed to a corresponding liquor and one or more photoactivators and fluorescent whitening agents can be added subsequently in the indicated amount. It is essential that the ready-for-use liquor contains photoactivator and fluorescent whitening agent in the indicated concentration.

Finally, the invention also provides a method of improving the appearance of used, in particular soiled, textiles, which method comprises treating said textiles, in the presence of oxygen, with a liquor which contains a composition of the invention, and irradiating the textiles direct in the liquor, or in the wet state outside the liquor, with light. This is accomplished by soaking, washing or rinsing the textiles in an aqueous liquor as defined herein. The irradiation necessary for activating the photoactivator can be effected with an artificial light source which affords light in the visible and/or infra-red range (e.g. incandenscent lamp, infra-red lamp), and the bleach or washing bath can be irradiated direct, whether by means of a light source inside the receptacle containing the liquor (e.g. lamp in the washing machine) or by a light source outside the receptacle. Likewise, the irradiation can also be effected once the textiles are removed from the treatment bath. In this case, the textiles should, however, still be moist and, if not, they must subsequently be moistened again. Sunlight can also serve as light source, in which case the textiles are preferably exposed to sunlight in the moist state after the treatment in the washing or bleach bath. Preferably the textiles can be irradiated by daylight while drying, e.g. on a washing line.

The method of the invention is advantageously carried out at a temperature in the range from 10° to 100°, especially 10° to 85° C., over a period of 15 minutes to 5 hours, preferably 15 minutes to 60 minutes.

The invention is illustrated in more detail by the following Examples, but is not restricted to what is described therein.

EXAMPLE 1

A detergent slurry consisting of 50 parts of deionised water and 50 parts of a detergent of the following composition is prepared:

| | % |
|---|---|
| linear sodium alkylbenzenesulfonate (chain length of the alkyl radical: $\overline{C}_{11.5}$) | 8.0 |
| tallow alcohol-tetradecane-ethylene glycol ether (14 oxyethylene groups) | 2.9 |
| sodium soap (chain lengths $C_{12-16}$: 13–26%) $C_{18-22}$: 74–87%) | 3.5 |
| sodium triphosphate | 43.8 |
| sodium silicate ($SiO_2$:$Na_2O$ = 3.3:1) | 7.5 |
| magnesium silicate | 1.9 |
| carboxymethyl cellulose | 1.2 |
| ethylenediamine tetraacetate | 0.2 |
| sodium sulfate, total | 21.2 |
| photoactivator | 0, 0.03% or 0.07% |
| fluorescent whitening agent | 0 or 0.13% |
| water to make up | 100% |

Aluminium phthalocyanine tetrasulfonate (referred to hereinafter as AlPCS) is used as photoactivator in a concentration of 0.03%, based on the weight of the detergent. In some experiments zinc phthalocyanine tetrasulfonate (referred to hereinafter as ZnPCS) is also used in a concentration of 0.07%.

An aluminium phthalocyanine of the formula

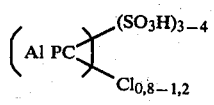

(25)

(Al PC=unsubstituted aluminium phthalocyanine) is also used as photoactivator (concentration: 0.03%) instead of aluminium phthalocyanine tetrasulfonate. The results obtained with this photoactivator are similar to those obtained with AlPCS. In the following Examples 1 to 6, the symbol AlPCS always includes also the compound of the formula (25).

Different types of fluorescent whitening agent are tested, all in a concentration of 0.13%, based on the weight of the detergent. Photoactivator and fluorescent whitening agent are added to the above detergent slurry which does not yet contain these two components, with the substantial exclusion of light, and the slurry is then dried for 4 hours in a drying chamber at 80° C. under a vacuum of about 400 torr. The detergent lumps are then forced through a sieve under which there is another sieve, so that a washing powder of uniform granular size is obtained.

The test substrates employed are strips of bleached cotton fabric which have been soiled as follows:

(a) 1 part of commercially available fruit juice (unfermented, no sugar or water added, pasteurised) is diluted with 1 part of deionised water. The cotton fabric is treated therein for 45 minutes in a liquor ratio of 1:20 and dried, without rinsing, at 60° C. The fruit juices employed were: cherry, elderberry, blackberry, red currant and bilberry.

(b) 10 g of tea are boiled in 1 liter of deionised water and filtered. Cotton strips are treated in the extract (2 hours at the boil and then 17 hours in the cooling liquor), rinsed, centrifuged, and dried warm. The test strips are used for the test after being stored for 1 week.

(c) EMPA test fabric (Art. 103, series 23)=cotton fabric stained with blood.

(d) EMPA test fabric (Art. 103, series 23)=cotton fabric stained with red wine.

Test strips of the above soiled fabrics are each washed for 30 minutes at 50° C. in a liquor containing 4 g/l of the detergent of this Example at a liquor ratio of 1:20, then rinsed briefly. The spin-moist strips are then hung on a line in daylight and left to dry for 6 hours (corresponding to about 250 Langley units). The strips are sprayed every 40 minutes with an alkaline solution (pH 9, corresponds to that of the wash liquor). This is a mode of application typical for photoactivators. The washes are carried out by varying the photoactivator and/or fluorescent whitening agent, whilst for each type of soiling all tests to be compared are carried out in parallel and simultaneously. Table I indicates the composition of the detergent in respect of photoactivator and fluorescent whitening agent (combinations of photoactivator/fluorescent whitening agent).

TABLE I

| Combination | Photoactivator | Fluorescent whitening agent (FWA) |
|---|---|---|
| ① | 0% | 0% |
| ② | 0.03% of AlPCS | 0.13% of the sodium salt of 4,4'-bis-(2-sulfostyryl)-diphenyl (FWA A) |
| ③ | 0.03% of AlPCS | 0.13% of the potassium salt of 4,4'-bis-(4-phenyl-1,2,3-triazol-2-yl)-2,2'-stilbene-disulfonic acid (FWA B) |
| ④ | 0.03% of AlPCS | 0.13% of the sodium salt of 4,4'-bis-(2''-anilino-4''-methylamino-1'',3'',5''-triazin-6''-yl-amino)stilbene-2,2'-disulfonic acid (FWA C) |
| ⑤ | 0.03% of AlPCS | 0.13% of sodium salt of 4,4'-bis-(2''-anilino-4''-morpholino-1'',3'',5''-triazin-6''-yl-amino)stilbene-2,2'-disulfonic acid (FWA D) |
| ⑥ | 0.03% of AlPCS | 0.13% of the sodium salt of 4,4'-bis-(2''-anilino-4''-methylethanolamino-1'',3'',5''-triazin-6''-yl-amino)stilbene-2,2'-disulfonic acid (FWA E) |
| ⑦ | 0.03% of AlPCS | 0% |
| ⑧ | 0.07% of ZnPCS | 0.13% of FWA B |
| ⑨ | — | 0.13% of FWA B |
| ⑩ | 0.07% of ZnPCS | — |

Within the scope of Example 1, only the combinations ① to ⑦ were tested. The tests reveal the following picture for all fabrics soiled as indicated above:

In test ① (without addition), more or less modest soil release effects are obtained. Distinct bleaching effects are obtained in test ⑦ (with AlPCS, without FWA). Compared with test ⑦, tests ④, ⑤ and ⑥ (with AlPCS and different FWAs normally employed in the detergent industry) effect in each type of soiling a specific change in shade which can be described as a trace to moderately brighter. Compared with one another, there are no noticeable differences between tests ④, ⑤ and ⑥. Test ② and ③, on the other hand, furnish what are clearly the best results for each type of soiling respect of stain removal and brightness of the treated fabrics.

EXAMPLE 2

The same detergent compositions are used under the same test conditions as in Example 1, except that a cotton fabric is soiled with a brown dye in accordance with Example 9 of German Offenlegungsschrift 2 812 278. The bleaching results obtained are very easily reproducible on account of the more level dyeing.

The results correspond to those of Example 1 with the other types of soiling. After washing, the strips can be divided into 4 groups:

only moderately whitened: combination 1 (without addition)

well whitened: combination 7 (only AlPCS)

well whitened with a somewhat brighter shade than 7 : combination 4 , 5 and 6 (AlPCS+-different FWAs)

by far the best white effects: combinations 2 and 3 .

EXAMPLE 3

With the object of quantifying the effects, different variants are tested under the same conditions as in Example 2 using a fluorescent whitening agent contained in compositions of the invention, namely FWA B (cf. Table I). Evaluation, however is made not only visually, but also colorimetrically. After they have been washed, the strips are measured in a Zeiss RFC 3 filter-spectrophotometer. The degree of whiteness is determined in accordance with the whiteness formula of Ganz (see Fluorescent Whitening Agents, Chapt. V/2 in Environmental Quality and Safety, ed. by Coulston+Korte, G. Thieme Verlag, Stuttgart). The combinations listed in Table II are tested (cf. also Table I). The degrees of whiteness obtained are also reported in Table II.

TABLE II

| Combination | | | Degree of whiteness | Improvement compared with (1) |
|---|---|---|---|---|
| (3) | 0.03% of AlPCS + | 0.13% of FWA B | 59 | 197 |
| (8) | 0.07% of ZnPCS + | 0.13% of FWA B | 20 | 158 |
| (1) | — | — | −138 | 0 |
| (9) | — | 0.13% of FWA B | −48 | 90 |
| (7) | 0.03% of AlPCS | — | −19 | 119 |
| (10) | 0.07% of ZnPCS | — | −68 | 70 |

It is clearly evident that the combinations contained in detergent compositions of the invention produce substantially better results than if the detergent contains either the photoactivator alone or the fluorescent whitening agent alone.

EXAMPLE 4

Under the same conditions as in Example 3, combinations are tested this time with a photoactivator and different fluorescent whitening agents. The results are reported in Table III.

TABLE III

| Combination | | | Degree of whiteness | Improvement compared with (7) |
|---|---|---|---|---|
| (2) | 0.03% of AlPCS + | 0.13% of FWA A | 53 | 72 |
| (3) | 0.03% of AlPCS + | 0.13% of FWA B | 59 | 78 |
| (4) | 0.03% of AlPCS + | 0.13% of FWA C | 28 | 47 |
| (7) | 0.03% of AlPCS | — | −19 | 0 |
| (1) | — | — | −138 | — |

The results in Table III show clearly that the combinations contained in compositions of the invention lead to substantially better results than combinations with other commercially available detergent FWAs.

EXAMPLE 5

The strips of Example 4 are further tested for their intrinsic white in order to verify the actual soil release. This is done by measuring the reflectance at 460 nm (R value) with xenon lamp irradiation using a UV suppression filter in accordance with DIN No. 44 983. The fluorescent whitening agent is thus not excited and only the intrinsic white is measured. The results are reported in Table IV.

TABLE IV

| Combination | | | R-value | Difference compared with (7) |
|---|---|---|---|---|
| (2) | 0.03% of AlPCS + | 0.13% of FWA A | 66.4 | 3.1 |
| (3) | 0.03% of AlPCS + | 0.13% of FWA B | 65.5 | 2.2 |
| (4) | 0.03% of AlPCS + | 0.13% of FWA C | 63.4 | 0.1 |
| (7) | 0.03% of AlPCS | — | 63.3 | 0 |
| (1) | — | — | 41.8 | — |

Whereas FWA C does not have any influence on the intrinsic white, the two FWAs contained in the compositions of the invention surprisingly effect an additional bleaching action which is markedly greater than that obtained with the photoactivator.

Using in Examples 1 to 5 one of the phthalocyanine compounds of the formulae $(AlPC)Br(SO_3H)_{3,5-4}$, $(AlPC)F(SO_3H)_{3,5-4}$, $(AlPC)I(SO_3H)_{3,5-4}$, $(ZnPC)Br(SO_3H)_{3,5-4}$ or $(ZnPC)I(SO_3H)_{3,5-4}$ as photoactivator instead of the aluminium phthalocyanine tetrasulfonate or the compound of the formula (25) (AlPCS) results substantially similar to those reported in Examples 1 and 2 and in Tables II to IV are obtained. In the above formulae AlPC denotes the aluminium phthalocyanine ring system and ZnPC denotes the zinc phthalocyanine ring system.

EXAMPLE 6

Using the detergent composition of Example 1 containing the combinations (2) (=0.03% of AlPCS and 0.13% of FWA A) and (5) (=0.03% of AlPCS and 0.13% of FWA D) of Table I, bleached unsoiled strips of thick cotton fabric which have not been pretreated with fluorescent whitening agent are washed under the following conditions:

Bundles of 6 of the cotton strips (10 g) are washed in a liquor ratio of 1:10 at 30° C. and 60° C. repsectively in a wash liquor containing 5 g/l of the detergent referred to above. The duration of each wash is 15 minutes. The strips are then rinsed for 30 seconds in running water and subsequently spin-dried for 15 seconds. Then the strips are dried on a line in daylight (up to 200 Langley units). This wash cycle (including drying) is repeated 9 times. The 6 cotton strips are then subjected to a 10th wash cycle (as described), which is discontinued after spin-drying. The 6 spin-moist strips are then inspected in a bundle and also by sorting through the bundle (the procedure followed by the housewife when she removes the heap of washed clothes from the washing machine and inspects it). The moist bundle of 6 cotton strips washed with the detergent containing combination ⑤ has an unattractive yellowish appearance (both after the wash at 30° C. and after that at 60° C.). In contrast, the bundle washed with the detergent containing combination ② (the combination of the invention) has a brilliant white hue, which imparts to the washing a pronounced clean appearance. This effect becomes especially clear when observed under light which is low in ultraviolet radiation (incandenscent lamp) and which is usually prevalent when washing is removed from a washing machine.

It is thus also evident here that, surprisingly, the combination contained in the compositions of the invention leads to much better results than the combination with another commercially available detergent fluorescent whitening agent.

Production of the compound of the formula (25) in Example 1 and referred to as AlPCS in the Examples An autoclave is charged with 128 g of phthalic dinitrile, 40 g of $AlCl_3$ and 650 g of 1,2-dichlorobenzene. After scavenging with nitrogen, the reaction mass is heated for 26 hours to about 170° C. After cooling and deaerating, the suspension is poured, with stirring, into 400 ml of water containing 100 g of trisodium phosphate. The batch is evaporated to dryness in a rotary evaporator and the residue is stirred with 750 ml of water. Then 60 g of 50% NaOH are added and the mixture is heated to 75° C. and kept for 2 hours at this temperature. Finally, the crude product is collected by filtration, stirred in 500 ml of water with 80 g of 32% HCl (2 hours at 90°–95° C.), filtered hot, and washed.

20 g of the above product are stirred in 240 ml of 33% oleum for 7 hours at 73°–76° C. The reaction mixture is then cooled to 25° C. and poured into a mixture of 1000 g of ice and 200 g of NaCl. The suspension is filtered and the filter residue is washed neutral with a 10% NaCl solution, then washed again with 300 ml of 10% HCl, and dried at 80° C. in vacuo. The product has the formula

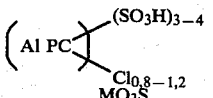

(25)

(AlPC=unsubstituted aluminium phthalocyanine).

What is claimed is:

1. In a composition for improving the appearance of used, in particular soiled, textiles, the improvement comprising the use of 0.0001 to 1% of a photoactivator, and 0.005 to 1.5%, in each case based on the total weight of the composition, of a fluorescent whitening agent selected from the group consisting of distyrylbiphenylsulfonic acids and their salts, 4,4'-bis-(1,2,3-triazol-2-yl)-2,2'-stilbenesulfonic acids and their salts, and mixtures thereof.

2. A composition according to claim 1, wherein the photoactivator is a phthalocyanine or a mixture of several phthalocyanines having a solubility in water of at least 0.01 g/l.

3. A composition according to claim 2, wherein the photoactivator is a sulfonated phthalocyanine of the formula $$Al\ X\ (PC)\text{–}(SO_3Y')_{v'} \text{ or } Zn\ (PC)\text{–}(SO_3Y')_{v'}$$

or a mixture of such phthalocyanines, wherein

PC denotes the phthalocyanine ring system,

X is an anion,

Y' is hydrogen, an alkali metal ion or an ammonium ion, and v' is any number from 1.3 to 4 (degree of sulfonation).

4. A composition according to claim 2, wherein the photoactivator is sulfonated phthalocyanine of the formula

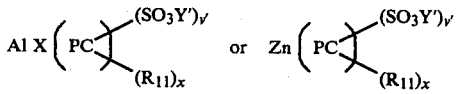

or a mixture of such phthalocyanines, wherein PC is the phthalocyanine ring system, X is an anion, Y' is hydrogen, an alkali metal ion or ammonium ion, each $R_{11}$, independent of the others, is fluorine, chlorine, bromine, iodine or cyano, v' is any number from 1.3 to 4 (degree of sulfonation) and x is any number from 0.1 to 4.

5. A composition according to either of claims 3 or 4, wherein the photoactivator is a sulfonated aluminium phthalocyanine of the formula

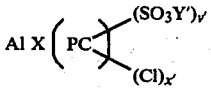

or a mixture of such aluminium phthalocyanines, wherein x' is 0 or any number from 0.5 to 4.

6. A composition according to claim 5, wherein X is a halide, sulfate, hydroxyl or acetate ion.

7. A composition according to claim 1 which contains, as fluorescent whitening agent, one or more compounds of the formula

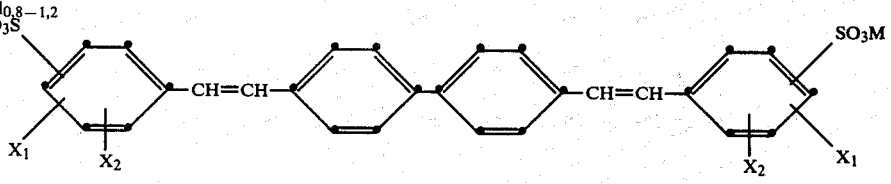

wherein $X_1$ is hydrogen, chlorine, bromine, or alkyl or alkoxy each containing 1 to 4 carbon atoms, $X_2$ is hydrogen or alkyl of 1 to 4 carbon atoms, and M is hydrogen, an alkali metal ion, ammonium ion or amine salt ion.

8. A composition according to claim 7 which contains a fluorescent whitening agent of the formula

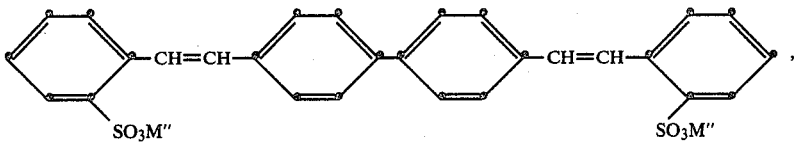

wherein M'' is hydrogen, sodium or potassium.

9. A composition according to claim 1 which contains a fluorescent whitening agent of the formula

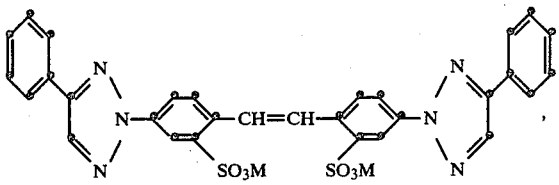

wherein M is hydrogen, an alkali metal ion, an ammonium ion or an amine salt ion.

10. A composition according to claim 1 which contains, as fluorescent whitening agent, a mixture of the compounds

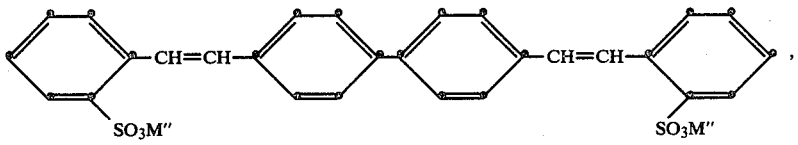

wherein M'' is hydrogen, sodium or potassium, and

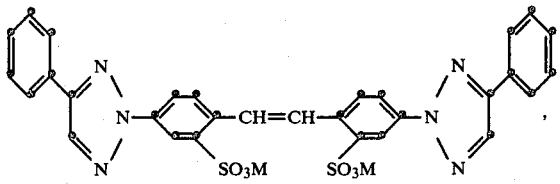

wherein M is hydrogen, an alkali metal ion, an ammonium ion or an amine salt ion.

11. A method of improving the appearance of used, in particular soiled, textiles, which method comprises treating said textiles with a liquor which contains a composition as defined in claim 1, and irradiating the textiles directly in the liquor, or in the wet state outside the liquor, with light.

12. A method according to claim 11, wherein the textiles, after removal from the liquor, are irradiated by exposure to daylight.

13. A method according to claim 11, wherein said liquor is a soaking liquor and wherein soiled textiles are soaked in said liquor.

14. A method according to claim 11, wherein said liquor is a detergent liquor and wherein soiled textiles are washed in said liquor.

15. A method according to claim 11, wherein said liquor is a rinsing liquor, and wherein already washed textiles are rinsed in said liquor.

16. A composition according to claim 1, wherein said photoactivator is present in an amount between 0.001 and 0.1% based on the total weight of the composition.

17. A composition according to claim 1, wherein said fluorescent whitening agent is present an amount between 0.01 and 0.5% based on the total weight of the composition.

18. A composition according to claim 2, wherein said phthalocyanine has a solubility in water of 0.1 to 20 g/l.

19. A composition according to claim 1, wherein said fluorescent whitening agent or agents is of the formula

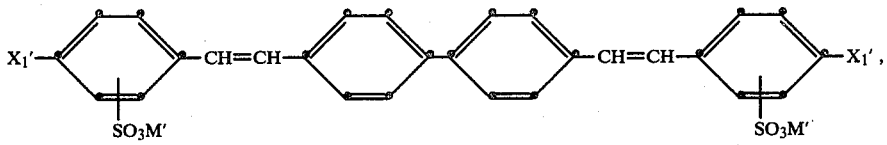

wherein $X_1'$ is hydrogen or chlorine and M' is hydrogen, sodium, potassium or ammonium.

20. A composition according to claim 1 which constitutes a detergent composition.

21. A composition according to claim 1 which constitutes a rinsing composition.

22. A composition according to claim 1 which constitutes a soaking composition.

23. A soaking, detergent or rinsing liquor containing 0.001 to 100 ppm of a photoactivator and 0.05 to 150 ppm, in each case based on the total liquor, of a fluorescent whitening agent which is selected from the group consisting of distyrylbiphenylsulfonic acids and salts thereof, 4,4'-bis-(1,2,3-triazol-2-yl)-2,2'-stilbenesulfonic acids and salts thereof, and mixtures thereof.

24. A liquor according to claim 23 containing 0.01 to 10 ppm of a photoactivator.

25. A liquor according to claim 23 containing 0.1 to 50 ppm of a fluorescent whitening agent.

* * * * *